United States Patent [19]

Kakimi et al.

[11] Patent Number: 4,642,281

[45] Date of Patent: Feb. 10, 1987

[54] ENCAPSULATED ELECTROSTATOGRAPHIC TONER MATERIAL

[75] Inventors: Fujio Kakimi; Takeshi Mikami, both of Fujinomiya, Japan

[73] Assignee: Fuji Photo Film Co., Ltd., Kanagawa, Japan

[21] Appl. No.: 592,911

[22] Filed: Mar. 23, 1984

[30] Foreign Application Priority Data

Mar. 23, 1983 [JP] Japan ..... 58-48418

[51] Int. Cl.[4] ..... G03G 9/16

[52] U.S. Cl. ..... 430/138; 430/106.6

[58] Field of Search ..... 430/106.6, 109, 111, 430/137, 138

[56] References Cited

U.S. PATENT DOCUMENTS 4,307,169 12/1981 Matkan ..... 430/138

4,455,362 6/1984 Naoi et al. ..... 430/137

4,497,885 2/1985 Ushiyama et al. ..... 430/137

*Primary Examiner*—John L. Goodrow

*Attorney, Agent, or Firm*—Toren, McGeady and Goldberg

[57] ABSTRACT

An encapsulated electrostatographic toner material preferably employable in a pressure fixing process and improved in the fixability after storage of the toner material comprising a core and a shell enclosing the core, in which:

said core comprises, a polymer, a solvent having a boiling point of not lower than 180° C. which is capable of dissolving the polymer or causing the polymer to swell, a colorant and a particulate magnetizable substance hydrophobically treated or coated on the surface; and said shell is prepared by an in-situ polymerization process such as an inner polymerization process or an outer polymerization process.

2 Claims, No Drawings

ENCAPSULATED ELECTROSTATOGRAPHIC TONER MATERIAL

BACKGROUND OF THE INVENTION

1. Field of the Invention

This invention relates to an encapsulated elecrtrostatographic toner material, and more particularly to an encapsulated electrostatographic toner material advantageously employable in a pressure fixing process.

2. Description of Prior Arts

There is known an electrostatography which comprises a stage of developing a tone electrostatic latent image contained on a photoconductive or dielectric surface with a toner material containing a colorant and a fixing aid (i.e., binder) to produce a visible toner image, and a subsequent stage of transferring and fixing the visible toner image onto a surface of a support medium such as a paper sheet.

The development of the latent image to produce a visible toner image is carried out by the use of either a developing agent consisting of a combination of a toner material with carrier particles, or a developing agent consisting of a toner material only. The developing process utilizing the combination of a toner material with carrier particles is named "two component developing process", while the developing process utilizing only a toner material is named "one component developing process".

The toner image formed on the latent image is then transferred onto a surface of a support medium and fixed thereto. The process for fixing the toner image to the support medium can be done through one of three fixing processes, that is, a heat fixing process (fusion process), a solvent fixing process and a pressure fixing process.

The pressure fixing process which involves fixing the toner material onto the surface of a support medium under application of pressure thereto is described, for instance, in U.S. Pat. No. 3,269,626. The pressure fixing process involving the use of neither a heating procedure nor a solvent produces no such troubles as inherently attached to either the heat fixing process or the solvent fixing process. Moreover, the pressure fixing process can be employed with a high speed automatic copying and duplicating process, and the access time is very short in the pressure fixing process. Accordingly, the pressure fixing process is considered to be an advantageous fixing process inherently having a variety of preferable features.

However, the pressure fixing process also has certain inadvantageous features. For instance, the pressure fixing process generally shows poorer fixablity than the heat fixing process does, whereby the toner image fixed onto a paper is apt to rub off easily. Further, the pressure fixing process requires very high pressure for the fixing operation, and such high pressure tends to break the cellulose fibers of the support medium such as paper sheet and also produces glossy surface on the support medium. Moreover, the pressing roller requires to have relatively greater size, because the roller necessarily imparts very high pressure to the toner image placed on the support medium. Accordingly, reduction of the size of a copying and duplicating machine cannot exceed a certain limit defined by the size of a pressing roller.

There has been previously proposed an encapsulated toner material which comprises toner particles enclosed with microcapsules, so as to overcome the above-described disadvantageous features of the pressure fixing process. The encapsulated toner material is generally prepared by enclosing a core material (containing a colorant such as carbon black) with a shell which is rupturable by the application of pressure in the developing stage. Thus prepared encapsulated toner material has various advantageous features; for instance, fixing of the encapsulated toner material does not require very high pressure but the fixability is high. Accordingly, the encapsulated toner material is viewed as suitable for the use in the pressure fixing process. However, the encapsulated toner materials proposed up to now appear unsatisfactory in practical use, because they fail to meet some of requirements required for providing smooth copying and duplicating operation and satisfactory toner image fixability and quality.

More in detail, it is required for the toner material for the use as a dry type developing agent in the electrostatography to have excellent powder characteristics (or, powder flowability) to provide high development quality, and to be free from staining the surface of a photosensitive material on which a latent image is to be formed.

Further, a toner material employed for the two component developing process is also required not to attain the surfaces of the carrier particles employed in combination. The toner material for the use as a developing agent in the pressure fixing process is furthermore required to be satisfactory in the fixability under pressure and not to undergo off-setting on the roller surface, that is, phenomenon that the toner adheres to the roller surface so as to stain it.

In summary, a toner material employed in the pressure fixing process ought to be at a high level in all characteristics such as powder characteristics (i.e., powder flowability), fixability onto a support medium (e.g., paper sheet) as well as presevability of the fixed image, resistance to the off-setting, and electron chargeability and/or electroconductivity depending on the system employed. The previously proposed encapsulated toner materials are unsatisfactory in some of these characteristics.

Moreover, an encapsulated toner to be employed in the one component developing system should contain a particulate magnetizable substance such as ferrite or magnetite in such an amount of approx. 40–60 wt. % in the core. However, it is rather difficult to enclose such a large amount of the particulate magnetizable substance within a microcapsule. In more detail, an encapsulated toner is generally prepared by dispersing (or emulsifying) an oily liquid containing core materials in an aqueous medium and subsequently forming a shell around the produced oily droplet of the core material. In this process, since the particulate magnetizable substance has hydrophilic property, it is difficult to completely enclose such large amount of the hydrophilic particulate magnetizable substance within the shell without releasing a portion of the substance outside.

With respect to the above-described problem, there has been proposed a process which comprises treating the surface of the particulate magnetizable substance to become hydrophobic and forming a shell around an oily core material containing the so hydrophobically treated particulate magnetizable substance by a surface polymerization process in U.S. Pat. No. 4,307,169. However, it is noted that the encapsulated toner prepared by the process is liable to show deterioration of the fixability and powder characteristics (or powder flowabity) in a storage for severe conditions such as 16 hours at 100° C. or a long period such as one month at room temperature, because the oily material contained in the core evaporates through the shell.

SUMMARY OF THE INVENTION

Accordingly, it is an object of the present invention to provide an encapsulated electrostatographic toner material which is improved particularly in fixability of the toner material after having been stored under severe conditions such as storage at a high temperature or storage for a long period at room temperature. The fixability means preservability of adhesion of the visible image of toner particles onto the support medium (e.g., paper sheet). More in detail, the fixing of the encapsulated toner is performed by passing a support medium carrying the toner image thereon through hard metal rollers to apply pressure onto the support medium, whereby the encapsulated toner is ruptured thereon and fixed. The heretofore known encapsulated toner material is not sufficient in the fixability after being stored under severe conditions, and the conventional toner is liable to easily rub off with a finger or other material such as a paper sheet to stain a portion other than the image portion. Such insufficient fixability of the conventional encapsulated toner material shown after storage is one reason to disturb practical use of the encapsulated toner material in the pressure fixing process.

Another object of the invention is to provide an encapsulated electrostatographic toner material which is improved in powder characteristics of the toner material after having been stored under severe conditions such as above, in addition of the improvement of the fixability after storage under severe conditions. The improvement in the powder characteristics means that the particles of the toner material are improved to behave in such a manner that most of the particles are independently present substantially free from formation of a mass of aggregated particles and smoothly flow in a developing apparatus, etc. Most of the heretofore known encapsulated toner materials are liable to aggregate to form massive products after having been stored under severe conditions such as storage at a high temperature or storage for a long period at room temperature or to aggregate to form massive products to disturb a developing process such as to produce lower resolution of a developed visible image, even though such toner materials show satisfactory flowability just after being prepared as dry particles. Such deterioration of the powder characteristics of the toner material after storage is another reason to disturb practical use of the encapsulated toner material in the pressure fixing process.

A further object of the invention is to provide an encapsulated electrostatographic toner material which is so improved as to be relatively free from deterioration of various characteristics of the toner materials after storage such as unsatisfactory off-setting, antistatic property, as well as the above-mentioned characteristics.

There is provided by the present invention an encapsulated electrostatographic toner material comprising a core and a shell enclosing the core, in which:

said core comprises, a polymer, a solvent having a boiling point of not lower than 180° C. which is capable of dissolving the polymer or causing the polymer to swell, a colorant and a particulate magnetizable substance hydrophobically treated or coated on the surface; and said shell is prepared by an in-situ polymerization process.

DETAILED DESCRIPTION OF THE INVENTION

The encapsulated electrostatographic toner material of the present invention can be prepared by a process which comprises dispersing or emulsifying an oily liquid containing the core material in an aqueous medium and then forming shell around the produced oily droplets by an in-situ polymerization process. The in-situ polymerization process utilized for the formation of the shell of the present invention is a known process which comprises formation of a shell around a core material by supplying a shell-forming reactive material (such as a monmer, monomers, or a prepolymer) from either inside or outside of the core material to the periphery of the core material.

Among various in-situ polymerization processes, an inner polymerization process comprising formation of a shell through supplying a shell-forming reactive material from only inside of the core material to the periphery of the core material is described in Japanese Patent Provisional Publication No. 50(1975)-22507. Such inner polymerization process can be utilized for the preparation of the encapsulated electrostatographic toner material of the present invention.

In more detail, the encapsulated toner of the present invention can be prepared in the following manner utilizing the inner polymerization process.

In an oily liquid containing a core material comprising a polymer, a solvent having a boiling point of not lower than 180° C. which is capable of dissolving the polymer or causing the polymer to swell (hereinafter may be termed a high-boiling solvent), a colorant and a particulate magnetizable substance hydrophobically treated or coated on the surface in a low-boiling solvent or a polar solvent are dissolved a first shell-forming material and a second shell-forming material which is reactive to the first shell-forming material to produce a polymer. The resulting mixture is dispersed in an aqueous medium to form oily droplets of the core material dispersed therein. The aqueous medium is then heated, so that the low-boiling solvent or polar solvent is released outside of the oily droplet, the shell-forming materials move to the surface of the oily droplet, and the polymerization reaction proceeds on the surface to produce a microcapsule enclosing the core material therewith.

In the above-described process, one or both of the first shell-forming material and the second shell-forming material can be replaced with plural shell-forming materials to produce a shell comprising plural polymers. If the first shell-forming material can react singly to produce a polymer, no second shell-forming material is required. The polymerization reaction can be any of a polyaddition reaction, a polycondensation reaction, a radical polymerization reaction, or an ionic polymerization. The polyaddition reaction and polycondensation reaction are advantageous. A catalyst can be utilized to perform the reaction efficiently.

There is no specific limitation on the shell-forming materials, so far as they react to each other to produce a water-insoluble, oil-insoluble polymer. Examples of the shell-forming materials include polyisocyanate, polyisothiocyanate, polyamine, polycarboxylic acid, polyvalent acid chloride, acid anhydride, epoxy group-containing compound (epoxy group), polyol, acrylate compound, polysulfide, lactone, and lactam. Prepolymers of these compounds can be also employed as the shell-forming materials. Otherwise, a polycondensation product of an aliphatic or aromatic polyamine and a dicarboxylic acid can be employed.

Examples of the polyisocyanate and polyisothiocyanate include:

diisocyanate such as m-phenylene diisocyanate, p-phenylene diisocyanate, 2,6-tolylene diisocyanate, 2,4-tolylene diisocyanate, naphthalene 1,4-diisocyanate, diphenylmethane 4,4'-diisocyanate, 3,3'-dimethoxy-4,4'-biphenyl diisocyanate, 3,3'-dimethyldiphenylmethane 4,4'-diisocyanate, xylylene 1,4-diisocyanate, xylylene 1,3-diisocyanate, 4,4'-diphenylpropane diisocyanate, trimethylene diisocyanate, hexamethylene diisocyanate, propylene 1,2-diisocyanate, butylene 1,2-diisocyanate, ethylidyne diisocyanate, cyclohexylene 1,2-diisocyanate, cyclohexylene 1,4-diisocyanate, p-phenylene diisocyanate, triphenylmethane diisocyanate, p-phenylene diisothiocyanate, xylylene 1,4-diisothiocyanate, and ethylidyne diisothiocyanate;

triisocyanate such as 4,4',4''-triphenylmethane triisocyanate, polymethylenepolyphenyl triisocyanate, toluene-2,4,6-triisocyanate;

tetraisocyanate such as 4,4'-dimethyldiphenylmethane 2,2',5,5'-tetraisocyanate; and polyisocyanate prepolymer such as an addition product of hexamethylene diisocyanate and hexanetriol, an addition product of 2,4-tolylene diisocyanate and catechol, an addition product of 2,4-tolylene diisocyanate and hexanetriol, an addition product of 2,4-tolylene diisocyanate and trimethylolpropane, an addition product of xylylene diisocyanate and trimethylolpropane.

Examples of the polyamine include aromatic polyamines such as 1,5-naphthalenediamine, o-phenylenediamine, m-phenylenediamine, 1,5-S-diaminonaphthalene, and phthalamide, and aliphatic polyamines such as N,N'-S-1,3-propylenediamine and N,N'-S-1,4-propylenediamine.

Examples of the polycarboxylic acids include pimelic acid, suberic acid, azelaic acid, sebacic acid, phthalic acid, terephthalic acid, 4,4-biphenyldicarboxylic acid, and 4,4'-sulfonindibenzoic acid.

Examples of the polyvalent acid chloride include terephthaloyl chloride, 1,5-naphthoyl chloride, 4,4'-biphenyldicarboxyloyl chloride, and 4,4'-oxydibenzoyl chloride.

Examples of the acid anhydride include anhydrides of two carboxylic acids or anhydrides of dicarboxylic acids such as maleic anhydride, succinic anhydride, phthaloyl anhydride, and benzoyl anhydride.

Examples of the epoxy group-containing compound include aliphatic glycidyl ethers such as diglycidyl ether, glycerol triglycidyl ether and a polyallylglycidyl ether having the molecular weight of 150–5,000; aliphatic glycidyl esters such as diglycidylester of linolein dimer acid; aromatic glycidyl ethers such as diglycidylether of Bisphenol A, triglycidylether of trihydroxyphenylpropane, and tetraglycidylether of tetraphenylene-ethane; and glycidyl ether-ester mixtures such as diglycidylether-ester of 4,4-bis(4-hydroxyphenyl)pentanoic acid.

Examples of the polyol include polyhydric aliphatic or aromatic alcohols, hydroxypolyester, and hydroxypolyalkylene ether.

Examples of the above-mentioned polyhydric alcohols include catechol, resorcinol, hydroquinone, 1,2-dihydroxy-4-methylbenzene, 1,3-dihydroxy-5-methylbenzene, 3,4-dihydroxy-1-methylbenzene, 3,5-dihydroxy-1-methylbenzen, 2,4-dihydroxy-1-ethylbenzene, 1,3-naphthalenediol, 1,5-naphthalenediol, 2,3-naphthalenediol, 2,7-naphthalenediol, o,o'-biphenol, p,p'-biphenol, 1,1'-bi-2-naphthol, Bisphenol A, 2,2'-bis(4-hydroxyphenyl)butane, 2,2'-bis(4-hydroxyphenyl)isopentane, 1,1'-bis(4-hydroxyphenyl)cyclopentane, 1,1'-bis(4-hydroxyphenyl)-cyclohexane, 2,2'-bis(4-hydroxy3-methylphenyl)propane, bis(2-hydroxyphenyl)-methane, xylylenediol, ethylene glycol, propylene glycol, 1,4-butanediol, 1,5-pentanediol, 1,6-heptanediol, 1,7-heptanediol, 1,8-octanediol, 1,1,1-trimethylolpropane, hexanetriol, pentaerythritol, glycerol, and sorbitol. Other polyhydric aliphatic alcohols and aromatic alcohols and phenols, and polyhydric alcohol derivatives employable in the present invention are described, for instance, in "Dye and Chemicals", 24, 38–55(1962).

Examples of the hydroxypolyester include compounds obtained from polycarboxylic acids and polyhydric alcohols. Exmaples of the polycarboxylic acid include malonic acid, succinic acid, glutaric acid, adipic acid, pimelic acid, meleic acid, isophthalic acid, terephthalic acid, and glycolic acid. Examples of the polyhydric alcohol are as mentioned above.

Examples of the hydroxypolyalkylene ether include condensation products of an alkylene oxie and a polyhydric alcohol. Examples of the alkylene oxide for the use of preparation of the hydroxy polyalkylene ether include ethylene oxide, propylene oxide, butylene oxide, and amylene oxide. Examples of the polyhydric alcohol are as mentioned above. The hydroxypolyalkylene ethers can be prepared from other starting compounds such as tetrahydrofuran and epichlorohydrin.

Examples of particularly useful hydroxypolyalkylene ether include compounds prepared from hydrophobic alkylene oxide containing 3–6 carbon atoms. For instance, polyethers such as condensation products between polypropylene oxide or polybutylene oxide and glycol, glycerol, pentaerythritol, or sorbitol can be mentioned. Also useful are continuous addition products of alkylenediamines (e.g., ethylenediamine) carrying an alkylene oxide, as well as polyols prepared by adding thereto a polyhydric alcohol. Examples of the product include N,N,N',N'-tetrakis(2-hydroxyethyl)ethylenediamine, N,N,N',N'-tetrakis(2-hydroxypropyl)ethylenediamine.

Examples of the polythiol include condensation proudcts of thioglycol, and reaction products of a polyhydric alcohol and an appropriate alcohol.

Examples of the acrylate include cyanoacrylates such as methyl $\alpha$-cyanoacrylate, propyl $\alpha$-cyanoacrylate and butyl $\alpha$-cyanoacrylate.

Example of the polyester acrylate include dimethacryl bis(ethylene glycol)phthalate.

Example of the polysulfide include products prepared from dihaloganated compounds and sodium sulfide, for instance, a compound represented by $(CH_2CH_2SSSS—)_n$.

Examples of the lactone and lactam compounds include bis-$\alpha$-angelica lactone, $\delta$-caprolactam, and $\eta$-caprylactam.

The shell-forming materials exemplified as above can be utilized for the formation of the shell in such combinations as given below.

In the case of employing as the first shell-forming material a polyisocyanate, polyisothiocyanate, polyisocyanate prepolymer or polyisothiocyanate prepolymer, the second shell-forming material generally is a polyol, polyamine, polythiol, acid anhydride, or epoxy compound.

In the case of employing as the first shell-forming material a polyamine, the second shell-forming material generally is a polycarboxylic acid, polyvalent acid chloride, epoxy compound, polyisocyanate, or polyester.

In the case of employing as the first shell-forming material a polycarboxylic acid, the second shell-forming material generally is a polyisocyanate, polyisothiocyanate, polyisocyanate prepolymer or polyisothiocyanate prepolymer.

In the case of employing as the first shell-forming material a polyvalent acid chloride, the second shell-forming material is a polyamine, polyol or polythiol.

In the case of employing as the first shell-forming material an acid anhydride, the second shell-forming material generally is a polyisocyanate, polyisothiocyanate, polyamine or epoxy compound.

In the case of employing as the first shell-forming material an epoxy compound, the second shell-forming material generally is a polyamine, polyisocyanate, polyisothiocyanate, polyisocyanate prepolymer, polyisothiocyanate prepolymer, polysulfide, acid anhydride, or polycarboxylic acid.

In the case of employing as the first shell-forming material a polyol, the second shell-forming material generally is a polyisocyanate, polyisothiocyanate, polyisocyanate prepolymer, polyisothiocyanate prepolymer, polycarboxylic acid, acid anhydride, or a polyvalent acid chloride.

In the case of employing as the first shell-forming material a lactone or lactam, the second shell-forming material generally is a polyisocyanate, polyisothiocyanate, polyisocyanate prepolymer, polyisothiocyanate prepolymer, or polyamine.

The combination of the first shell-forming material and the second shell-forming material generally is selected upon consideration of characteristics required for the shell.

The reaction between the first shell-forming material and the second shell-forming material is preferably accelerated, as described hereinbefore, by the use of a catalyst. A wide variety of catalysts can be employed for this purpose. For instance, in the case of employing a polyisocyanate or polyisothiocyanate as the first shell-forming material, the following catalysts are preferred.

(1) Tertiary amines such as trimethylamine, triethylamine, -methylmorpholine, N-ethylmorpholine, N,N'-dimethylethanolamine, triethanolamine and triethylene diamine.

(2) Organic tin compounds such as dibutyltin diacetate, dibutyltin dilaurate, dibutylthin laurate, dibutyltin maleate, dibutyltin laurate maleate and dibutyltin bis(6-methylaminocaproate).

(3) Tertiary phosphine such as trialkylphosphines and dialkylbenzylphosphines.

(4) Salts of organic acids and various metals (e.g., tn, lead, cobalt, nicekl, and copper) such as stnnous octoenate, stannous oleate, lead octoenate, and cobalt naphthanate.

In order to prepare a shell having excellent characteristics, a low-boiling solvent or a polar solvent is preferably employed in the course of the encapsulation.

The low-boiling solvent preferably has lower boiling point than the aqueous medium serving as the continuous phase. The low-boiling solvent necessarily dissolves the first and second shell-forming materials and is miscible with the oily liquid.

Examples of the low-boiling solvents having these properties include n-pentane, methylene chloride, ethylene chloride, carbon disulfide, acetone, methyl acetate, chloroform, methyl alcohol, tetrahydrofuran, n-hexane, carbon tetrachloride, ethyl acetate, ethyl alcohol, methyl ethyl ketone, benzene, ethyl ether, and petroleum ether. These solvents can be employed singly or in combination.

The polar solvent necessarily dissolves the first and second shell-forming materials and is miscible with the oily liquid. Also necessary is that the polar solvent can be dissolved in the aqueous medium serving as the continuous phase. However, the boiling point of the polar solvent may be higher or lower than that of the aqueous solvent serving as the continuous phase.

Examples of the polar solvent having these properties include dioxane, cyclohexanone, methyl isobutyl ketone and dimethylformamide.

The continuous phase is generally formed by water. However, a compound being nearly equivalent to water such as ethylene glycol, glycerol, butyl alcohol, octyl alcohol or a mixture of the equivalent compound and water can be employed in place of water.

A protective colloid or surface active agent can be employed for dispersing the core material in the aqueous medium.

Examples of compounds serving as the protective colloide include natural and synthetic hydrophilic polymers such as gelatin, gum arabic, casein, carboxymethylcellulose, starch and polyvinyl alcohol.

Examples of the suface active agent include anionic surface active agent such as alkylbenzenesulfonates, alkylnaphthalenesulfonates, polyoxyethylenesulfates, and Turky red oil; and nonionic surface active agents such as polyoxyethylene alkyl ethers, polyoxyethylene alkyl phenol ethers, and sorbitane aliphatic acid esters.

The amount of the shell-forming material(s) can be decided depending upon the amount of the core material and the desired thickness of the shell.

The catalyst which is preferably employed to accelerate the reaction between the first shell-forming material and the second shell-forming material is generally employed in an amount ranging from approx. 0.01 to 5 wt. % per the total amount of the shell-forming materials.

The process for the preparation of the encapsulated toner of the present invention by way of the outer polymerization process is described below.

An examples of the outer polymerization process is a process which comprises supplying a precondensate from the aqueous medium to the surface of the core matrial in the form of oily droplets and then forming the shell.

An outer polymerization process for the preparation of microcapsules by forming in an aqueous medium a melamine resin shell around the core material comprising a colorant and a binder is already known. This process is described in, for instance, Japanese Patent Provisinal Publications Nos. 55(1980)-15660 55(1980)-47139, and 56(1981)-51238 and U.S. Pat. Nos. 4,100,103 and 4,233,178.

An outer polymerization process for the preparation of microcapsules by forming in an aqueous medium a urea resin shell around the core material comprising a colorant and a binder is already known. This process is described in, for instance, Japanese Patent Provisinal Publication No. 55(1980)-119438 and U.S. Pat. No. 4,221,710.

The outer polymerization can be utilized for the preparation of the encapsulated toner material of the present invention in the following manner.

In the first place, the aforementioned oily liquid containing the core material is dispersed in an aqueous medium containing an anionic protective colloid. Subsequently, a combination of melamine and formaldehyde or a melamine-formaldehyde precondensate is added to the dispersion (emulsion), and the outer polymerization is performed around the oily core material droplets by adjustment of pH and/or temperature to form shells.

The inner polymerization process and the outer polymerization process can be utilized in combination.

The core material contains a colorant for producing a visible image from the latent image. The colorant generally is a dye or a pigment, but a certain agent providing no directly visible image such as fluorescent substance can be employed as the colorant, if desired.

The colorant is generally selected from a variety of dyes, pigments and the like employed generally in the conventional electrostatographic copying and duplicating process. Generally the colorant is a black toner or a chromatic toner. Examples of the black toners include carbon black. Examples of the chromatic toners include blue colorants such as copper phthalocyanine and a sulfonamide derivative dye; yellow colorants such as a benzidine derivative dye, that is generally called Diazo Yellow; and and red colorants such as Rhodamine B Lake, that is, a double salt of xanthine dye with phosphorus wolframate and molybdate, Carmine 6B belonging to Azo pigment, and a quinacridone derivative.

The binder included in the core is a combination of a polymer, and a solvent having a boiling point of not lower than 180° C. which is capable of dissolving the polymer or causing the polymer to swell. The binder serves within the core to disperse the colorant and the particulate magnetizable substance (e.g., magnetite or ferrite) treated or coated hydrophobically on the surface, and further serves in the course of fixing a toner image made of the colorant on the latent image onto a support medium such as a paper sheet.

Examples of the solvent having a boiling point not lower than 180° C. (high-boiling solvent) employable as one component of the binder in the present invention include the following compounds:

(1) Phthalic acid esters dibutyl phthalate, dihexyl phthalate, diheptyl phthalate, dioctyl phthalate, dinonyl phthalate, dodecyl phthalate, butyl phthalyl butyl glycolate, dibutyl monofluorophthalate;

(2) Phosphoric acid esters tricresyl phosphate, trixylenyl phosphate, tris(isopropylphenyl) phosphate, tributyl phosphate, trihexyl phosphate, trioctyl phosphate, trinonyl phosphate, tridecyl phosphate, trioleyl phosphate, tris(butoxyethyl) phosphate, tris(chloroethyl) phosphate, tris(dichloropropyl) phosphate;

(3) Citric acid esters

O-acetyl triethyl citrate, O-acetyl tributyl citrate, O-acetyl trihexyl citrate, O-acetyl trioctyl citrate, O-acetyl trinonyl citrate, O-acetyl tridecyl citrate, triethyl citrate, tributyl citrate, trihexyl citrate, trioctyl citrate, trinonyl citrate, tridecyl citrate;

(4) Benzoic acid esters butyl benzoate, hexyl benzoate, heptyl benzoate, octyl benzoate, nonyl benzoate, decyl benzoate, dodecyl benzoate, tridecyl benzoate, tetradecyl benzoate, hexadecyl benzoate, octadecyl benzoate, oleyl benzoate, pentyl o-methylbenzoate, decyl p-methylbenzoate, octyl o-chlorobenzoate, lauryl p-chlorobenzoate, propyl 2,4-dichlorobenzoate, octyl 2,4-dichlorobenzoate, stearyl 2,4-dichlorobenzoate, oleyl 2,4-dichlorobenzoate, octyl p-methxybenzoate;

(5) Aliphatic acid esters hexadecyl myristate, dibutoxyethyl succinate, dioctyl adipate, dioctyl azelate, decamethylene-1,10-diol diacetate, triacetin, tributin, benzyl caprate, pentaerythritol tetracaproate, isosorbitol dicaprilate;

(6) Alkylnaphthalenes methylnaphthalene, dimethylnaphthalene, trimethylnaphthalene, tetramethylnaphtharene, ethylnaphthalene, diethylnaphthalene, triethylnaphthalene, monoisopropylnaphthalene, diisopropylnaphthalene, tetraisopropylnaphthalene, monomethylethylnaphthalene, isooctylnaphthalene;

(7) Dialkylphenyl ethers di-o-methylphenyl ether, di-m-methyldiphenyl ether, di-p-methylphenyl ether;

(8) Amides of fatty acids and aromatic sulfonic acids

N,N-dimethyllauroamide, N,N-diethylcaprylamide, N-butylbenzenesulfonamide;

(9) Trimellitic acid esters trioctyl trimellitate;

(10) Diarylalkanes diarylmethanes such as dimethylphenylphenylmethane, diarylethanes such as 1-methylphenyl-1-phenylethane, 1-dimethylphenyl-1-phenylethane and 1-ethylphenyl-1-phenylethane.

For the purpose of the invention, the above-mentioned high-boiling solvent is preferably selected from phthalic acid esters, phosphoric acid esters, diarylalkanes and alkylnaphthalenes.

The core material of the encapsulated toner of the invention preferably contains an organic liquid having a boiling point in the range of 100° to 250° C., preferably 140° to 220° C. which is substantially incapable of dissolving the polymer to be included in the core material or causing the polymer to swell is preferably selected from the group consisting of aliphatic saturated hydrocarbon and organic liquid mixtures containing as main component an aliphatic saturated hydrocarbon.

The aliphatic saturated hydrocarbon generally is available and employed in various use in the form of a mixture of plural aliphatic saturated hydrocarbon distillates having a certain boiling point range. Examples of the aliphatic saturated hydrocarbon preferably employable as the non-dissolving liquid of the present invention include aliphatic saturated hydrocarbon mixtures having boiling point ranges (from initial boiling point to drying point) of 115°–142° C. (e.g., ISOPAR E, available from Exxon Chemicals), of 158°–177° C. (e.g., ISOPAR G), of 174°–189° C. (e.g., ISOPAR H), of 188°–210° C. (e.g., ISOPAR L, and of 207°–258° C. (e.g., ISOPAR M).

If the organic liquid is employed, there is no limitation on a ratio (ratio by weight) of the organic liquid liquid to the high-boiling point solvent, but the ratio of the former/latter preferably ranges from 9/1 to 1/9.

Examples of the polymer contained as another component in the core material include the following polymers:

polyolefin, olefin copolymer, polystyrene, styrene-butadiene copolymer, epoxy resin, polyester, natural and synthetic rubbers, poly(vinylpyrrolidone), polyamide, cumarone-indene copolymer, methyl vinyl ether-maleic anhydride copolymer, maleic acid-modified phenol resin, phenol-modified terpene resin, silicone resin, epoxy-modified phenol resin, amino resin, polyurethane elastomer, polyurea elastomer, homopolymer and copolymer of acrylic acid ester, homopolymer and copolymer of methacrylic acid ester, acrylic acid-long chain alkyl methacrylate copolymer oligomer, poly(vinyl acetate), and poly(vinyl chloride).

In the present invention, the polymer is preferably selected from the group consisting of homopolymers and copolymers of acrylic acid esters (acrylates), homopolymers and copolymers of methacrylic acid esters (methacrylates), and styrene-butadiene copolymers.

In the invention, each of the high-boiling solvent, (if desired, the organic liquid) and the polymer can be employed alone or in combination.

There is no limitation on a ratio (ratio by weight) of the high-boiling solvent (+the organic liquid) to the polymer, but the ratio is preferably chosen within the range of 0.1–40, more preferably 0.2–10 (high-boiling solvent (+organic liquid) per polymer).

The combination of the high-boiling solvent (which may be combined with the organic liquid, the same hereinafter), and the polymer may form a highly viscous liquid depending on natures of these materials or the ratio of these materials. Such highly viscous liquid is rather difficultly emulsified (or dispersed) in water in the initial stage of the encapsulation process. In such cases, the viscosity can be reduced by adjustment of the amount of the low-boiling solvent or polar solvent.

As described hereinbefore, the core of the encapsulated toner materail of the invention contains a particulate magnetizable substance which is coated or treated hydrophobically on the surface. Representative examples of the magnetizable substance include ferrite and magnetite.

The treatment of the particulate magnetizable material to turn its surface to have hydrophobic property is already known. Examples of the treatment method include the following method.

(1) Method utilizing a coating process

The particulate magnetizable substance is dispersed in a solution containing a polymer or surface active agent so that the polymer or surface active agent is absorbed by or deposited on the surface of the particulate substance. A dry coating method is also employable.

(2) Topochemical method

The topochemical method can be carried out by utilizing a reaction of an organic compound (e.g., alcohol) to the functional groups (e.g., OH group or COOH group) attached to the surface of the particulate magnetizable material, such as an esterification reaction. Otherwise, this method can be carried out by surface treatment using a silane coupling agent or a titanium coupling agent.

(3) Method utilizing mechanochemical reaction

The particulate magnetizable substance was treated to produce a fresh surface and to graft monomers to the so produced active surface by pulverizing the substance in cojunction with an organic compound under a nitrogen condition or in a liquid.

(4) Method utilizing polymerization reaction on surface of particulate substance A polymer is grafted to the surface of the particulate magnetizable substance in the presence of a compound to activate the surface thereof. A hydrocarbon is also polymerized to adhere to the surface of the particulate magnetizable substance in a similar manner.

These methods and other utilizable methods are described in detail in "Coloring Material (in Japanese)", 49, 2 (1976) by Eiichi Tsuruta.

In the present invention, the surface of the particulate magnetizable substance is preferably converted to show hydrophobical property by the use of an organic polymer or an organic silane compound. Examples of preferable organic polymer include polyethylene resin, polystyrene resin, polyacryl resin, epoxy resin, polyurethane resin, polyurea resin, and polyamide resin. Examples of preferable organic silane compound include alkoxysilanes such as phenyltriethoxysiline, methyltriethoxysilane, and other alkyltriethoxysilanes.

The core material of the invention may contain various additives in addition to the above-mentioned constitutional substances. For instances, a fluorine-containing resin being effective in prevention of the off-setting can be included.

The resinous shell of the encapsulated toner can be provided with a charge control agent such as a metal-containing dye or nigrosine, a flow improving agent such as hydrophobic silica, or other additive. These additive can be introduced into the shell of the encapsulated toner in an optional stage such as in the course of formation of the shell or after separating and drying the encapsulated toner.

The microcapsules prepared by forming shell around the above-mentioned core material are separated from the liquid phase (i.e., aqueous meidum) and then dried. The separating-drying procedure can be generally performed by spray-drying a dispersion containing the microcapsules. Also emplyable is a freeze-drying process. Otherwise, the dispersion is first subjected to centrifugal separation to remove the reaction liquid and the resulting microcapsules (which may be in the form of a slurry) is then heated, for instance, in an oven. By utilizing one of these processes, a powdery encapsulated toner material is obtained.

It is preferred that the microcapsules are washed with water after having been separated from the reaction liquid, for instance, through centrifuge and prior to being subjected to the drying, so that an amount of the protective colloid or surface active agent possibly attached to the surface of the microcapsule can be reduced.

The dried encapsulated toner is preferably heated to further improve its powder characteristics. The temperature for heating the dried encapsulate toner preferably ranges from 50° to 300° C., and more preferably ranges from 80° to 150° C. The period required for performing the heating varies with the heating temperature, the nature of the core material, etc. Generally, the period ranges from 10 minutes to 48 hours, and preferably ranges from 2 to 24 hours.

There is no limitation on the means employed for carrying out the heating procedure. Examples of the heating means include an electric furnace, a muffle furnace, a hot plate, an electric drying oven, a fluid bed drying apparatus, and a infrared drying apparatus.

As described hereinbefore, the encapsulated electrostatographic toner material of the present invention shows satisfactory preservability even containing a large amount of the magnetizable substance in the core.

It is not clear why the encapsulated toner material of the invention shows the excellent preservability improved as compared with the conventional similar encapsulated toner. However, it is assumed that the hydrophobically surface-treated magnetizable substance has affinity to the binder comprising the polymer and the high-boiling solvent (further the aforementioned organic liquid, if employed) so that the magnetizable substance is easily enclosed within the core material in the form of oily droplets, and further that the shell material prepared through the in-situ polymerization process such as the inner polymerization process or the outer polymerization process encloses with a high-sealing coating layer the magnetizable substance even if a portion of the substance is protruded outside the core material.

In other words, as far as the in-situ polymerization process is utilized, the magnetizable substance located on the interface between the oily droplet of the core material and the aqueous medium (continuous phase) can be coated with a polymer film on the oily droplet side in the case of using the inner polymerization process or on the aqueous liquid side in the case of using the outer polymerization process. Thus, a high-sealing shell is formed around the core, and evaporation of the high-boiling solvent (including the organic liquid, if employed together) through the shell is effectively suppressed.

In contrast, if a surface polymerization process comprising formation of shell of a polymer by reaction between a shell-forming material supplied from the oily droplent and a shell-forming material supplied from the aqueous medium on is employed for the preparation of the shell around the core material containing a large amount of the magnetizable substance, the formed polymer layer is laible to be discontinuous on or in the vicinity of the magnetizable substance to reduce the sealing property of the formed shell.

The present invention will be illustrated by the following examples which are by no means intended to introduce any restriction into the invention.

EXAMPLE 1

Preparation of Microcapsules by Inner Polymerization Process

In 27 g. of ethyl acetate was dissolved 3 g. of polymethyl methacrylate (Torex, available from Toray Industries Inc., Japan) under heating. The resulting solution was kneaded with 50 g. of magnetite (EPT-1000, available from Toda Kogyo Co., Ltd., Japan) in an automartar for approx. 2 hours, and ethyl acetate was removed by evaporation. The mixture was then kneaded with 40 g. of 1-isopropylphenyl-2-phenylethane containing 25 wt.% of polyisobutyl methacrylate (Acrybase MM-2002-2, available from Fujikura Kasei Co., Ltd., Japan) and 25 wt.% of another polyisobutyl methacrylate (Acrybase MM-2002-1, the same) in an auto-mortar for 5 hours to prepare a magnetizable ink.

Independently, 2.2 g. of terephthaloyl chloride, 9.9 g. of Desmodur L (toluene diisocyanate-hexanetriol 1:3 (molar ratio) addition compound) and 0.5 g. of 1,5-naphthalene diamine were dissolved in 20 g. of ethyl acetate. The resulting solution was then mixed with the magnetizable ink. The mixture was emulsified in 200 g. of an aqueous solution containing 5% methylcellulose (Metholose 60SH, Shinetsu Chemical Industry Co., Ltd., Japan) by means of a mixer. The emulsion was adjusted to have oily droplets of mean droplet size approx. 13 μm, and after approx. 10 min. was adjusted to pH 9.0 by addition of aqueous 20% sodium carbonate solution. The emulsion was then stirred for approx. 3 hours in a thermostat kept at 75° C. to complete the encapsulating reaction.

The produced microcapsules were sedimented spontaneously and the supernatant water was replaced with a fresh water. This procedure was repeated ten times to carry out washing of the microcapsules. Subsequently, the resulting microcapsule slurry was heated in an oven at 60° C. for 5 hours, to obtain a powdery encapsulated toner.

The obtained encapsulated toner shows very satisfactory preservability as shown in the following data.

EXAMPLE 2

Preparation of Microcapsules by Inner Polymerization Process

The procedure of Example 1 was repeated except that the polymethyl methacrylates were replaced with the same amount of a silane coupling agent (methyltriethoxysilane), to obtain a powder encapsulated toner.

The obtained encapsulated toner shows very satisfactory preservability as shown in the following data.

EXAMPLE 3

Preparation of Microcapsules by Inner Polymerization Process

The procedure of Example 1 was repeated except that the polymethyl methacrylates and ethyl acetate were replaced respectively with the same amounts of polystyrene and benzene, to obtain a powder encapsulated toner.

The obtained encapsulated toner shows very satisfactory preservability as shown in the following data.

EXAMPLE 4

Preparation of Microcapsules by Outer Polymerization Process

In 95 g. of hot water at 80° C. was dropwise added 5 g. of sodium polyvinylbenzenesulfonate (partial sodium salt, average molecular weight 500,000) under stirring, and then the stirring was continued for additional 30 min. to make a solution. The resulting solution (pH 2–3) was cooled and adjusted to pH 4.0 by addition of 20% aqueous sodium hydroxide solution. 100 g. of this solution was mixed with 100 g. of a magnetizable ink prepared in the same manner as in Example 1 to prepare an emulsion containing oily droplets of mean droplet size approx. 10 μm.

Independently, 6 g. of melamine and 11 g. of 37% formaldehyde were added 83 g. of water, and the mixture was heated to 60° C. under stirring. The stirring was continued for additional 30 min. at the same temperature to prepare an aqueous melamine-formaldehyde precondensate solution (pH 6–8).

The above aqueous solution was mixed with the aforementioned emulsion, and the mixture was adjusted to pH 6.0 by addition of 20% aqueous acetic acid solution under stirring. The resulting mixture was further stirred at 65° C. for 2 hours. The produced microcapsule dispersion was cooled to room temperature and adjusted to pH 9.0 by addition of 20% aqueous sodium hydroxide solution.

Thus obtained aqueous microcapsule dispersion was subjected to centrifugal separation to separate the microcapsules from water. The separated microcapsules were then dispersed in water. The resulting dispersion was again subjected to centrifugal separation and the separated microcapsules were again dispersed in water in the same manner as above. This procedure was repeated three times to wash the microcapsules with water.

The microcapsule slurry was spray-dried in a spray-dryer (available from Yamato Kagaku Co., Ltd., Japan) under the conditions that the entrance temperature was 200° C., the exit temperature was 90° C., and the atomizing pressure was 4 kg/cm$^2$ to obtain a powdery encapsulated toner.

The obtained encapsulated toner shows very satisfactory preservability as shown in the following data.

COMPARISON EXAMPLE 1

Preparation of Microcapsules by Surface Polymerization Process 2.2 g. of terephthaloyl chloride and 9.9 g. of Desmodur L (toluene diisocyanate-hexanetriol 1:3 (molar ratio) addition compound) were dissolved in 20 g. of ethyl acetate. The resulting solution was then mixed with 100 g. of a magnetizable ink prepared in the same manner as in Example 1. The mixture was emulsified in 200 g. of an aqueous solution containing 5% methylcellulose (Metholose 60SH, Shinetsu Chemical Industry Co., Ltd.) by means of a mixer. The emulsion was adjusted to have oily droplets of mean droplet size approx. 13 μm, and at approx. 10 min. after addition of 14 g. of 5 wt.% aqueous hexamethylenediamine solution, the emulsion was adjusted to pH 9.0 by addition of aqueous 20% sodium carbonate solution. The emulsion was then stirred for approx. 3 hours in a thermostat kept at 75° C. to complete the encapsulating reaction.

The produced microcapsules were sedimented spontaneously and the supernatant water was replaced with a fresh water. This procedure was repeated ten times to carry out washing of the microcapsules. Subsequently, the resulting microcapsule slurry was heated in an oven at 60° C. for 5 hours, to obtain a powdery encapsulated toner.

The obtained encapsulated toner shows practically unsatisfactory preservability as shown in the following data.

COMPARISON EXAMPLE 2

Preparation of Microcapsules by Surface Polymerization Process

The procedure of Comparison Example 1 was repeated except that the the magnetizable ink was replaced with the same amount of the magnetizable ink prepared in Example 2, to obtain a powder encapsulated toner.

The obtained encapsulated toner shows practically unsatisfactory preservability as shown in the following data.

COMPARISON EXAMPLE 3

Preparation of Microcapsules by Surface Polymerization Process

The procedure of Comparison Example 1 was repeated except that the the magnetizable ink was replaced with the same amount of the magnetizable ink prepared in Example 3, to obtain a powder encapsulated toner.

The obtained encapsulated toner shows practically unsatisfactory preservability as shown in the following data.

EVALUATION OF PRESERVABILITY OF ENCAPSULATED TONER

The encapsulated toners obtained in Examples 1–4 and Comparison Examples 1–3 were examined on the preservability (i.e., preservability of oily material in the core) on storage in the following manner.

1 g. of the powdery encapsulated toner was kept in an oven at 100° C. for 16 hours, and 48 hours. Thereafter, the oily material remaining in the core was weighed to determine the amount of the remaining oily material.

The results are set forth in Table 1. In Table 1, the amount of the remaining oily material is expressed in terms of a ratio (% by weight) of the amount of oily material remaining after the heat treatment based on the original amount having been subjected to the storage test.

TABLE 1

| Sample | After 16 hrs. | After 48 hrs. | Conclusion |
|---|---|---|---|
| Example 1 | 100% | 80% | Satisfactory |
| 2 | 95% | 85% | Satisfactory |
| 3 | 100% | 85% | Satisfactory |
| 4 | 100% | 100% | Satisfactory |
| Com. Ex. 1 | 80% | 50% | Poor |
| 2 | 70% | 40% | Poor |
| 3 | 80% | 70% | Poor |

EVALUATION OF ENCAPSULATED TONER

The encapsulated toners obtained in Examples 1–4 and Comparison Examples 1–3 were evaluated in terms of the characteristics required for the electrostatographic developing agent in the following manner.

For each encapsulated toner, a sample having been subjected to no heat treatment and samples having been heated to 100° C. for 16 hours as above were employed as the developing agents for developing an electrostatographic latent image formed in the conventional electrostatographic process. The produced toner image was transferred onto a paper sheet and pressed thereonto at 150 kg/cm$^2$ by means of a prssing roller, and the condition of the fixation was observed.

The fixation observed in the case of using any of the encapsulated toners obtained in Examples 1–4 was ovserved satisfactory, and no difference was noted between the non-heat treated toner and the heat-treated toner. In contrast, the fixations of toner images provided by toners of Comparison Examples 1–3 were poor in the case of using the heat-treated samples, while the non-heat treated toners were satisfactory.

We claim:

1. An encapsulated electrostatographic toner material comprising a core and a shell enclosing the core, in which:

said core comprises a polymer, a solvent having a boiling point of not lower than 180° C. selected from the group consisting of phthalic acid esters, phosphoric acid esters, diarylalkanes and alkylnaphthalenes, which is capable of dissolving the polymer or causing the polymer to swell, a colorant and a particulate magnetizable substance hydrophobically treated or coated on the surface; and said shell is prepared by an in-situ inner or outer polymerization process.

2. The encapsulated electrostatographic toner material as claimed in claim 1, in which said core further contains an organic liquid having a boiling point in the range of 100° to 250° C. which is substantially incapable of dissolving the polymer or causing the polymer to swell.

* * * * *